US007028728B2

(12) United States Patent
Liu

(10) Patent No.: US 7,028,728 B2
(45) Date of Patent: Apr. 18, 2006

(54) WOOD PLANING MACHINE WITH COUPLING UNITS

(75) Inventor: Chin Yuan Liu, Taichung (TW)

(73) Assignee: Shinmax Industry Co., Ltd., Taichung Hsien (TW)

( * ) Notice: Subject to any disclaimer, the term of this patent is extended or adjusted under 35 U.S.C. 154(b) by 43 days.

(21) Appl. No.: 10/951,215

(22) Filed: Sep. 27, 2004

(65) Prior Publication Data

US 2006/0011265 A1 Jan. 19, 2006

(30) Foreign Application Priority Data

Jul. 13, 2004 (TW) ..... 93210990 U

(51) Int. Cl.
*B27C 1/00* (2006.01)

(52) U.S. Cl. ..... 144/117.1; 144/130

(58) Field of Classification Search ..... 144/114.1, 144/117.1, 130, 475, 478; 409/206, 210, 409/218

See application file for complete search history.

(56) References Cited

U.S. PATENT DOCUMENTS 6,315,015 B1 * 11/2001 Chang ..... 144/117.1
6,415,829 B1 * 7/2002 Chiang ..... 144/130
6,427,734 B1 8/2002 Chiang
6,655,427 B1 * 12/2003 Chiang ..... 144/130

* cited by examiner

*Primary Examiner*—Derris H. Banks
*Assistant Examiner*—Shelley Self
(74) *Attorney, Agent, or Firm*—Frommer Lawrence & Haug LLP; Ronald R. Santucci

(57) ABSTRACT

A wood planing machine includes a cutter carriage mounted movably on screw rods, upper and lower couplers mounted adjustably on the cutter carriage and threadedly engaging the screw rods, and upper and lower screws for securing the upper and lower couplers to the cutter carriage. The upper and lower screws are operable to permit position adjustment of the upper and lower couplers relative to the cutter carriage to a tightening position.

3 Claims, 5 Drawing Sheets

WOOD PLANING MACHINE WITH COUPLING UNITS

CROSS-REFERENCE TO RELATED APPLICATION

This application claims priority of Taiwanese Patent Application No. 093210990, filed on Jul. 13, 2004.

BACKGROUND OF THE INVENTION

1. Field of the Invention

This invention relates to a wood planing machine, more particularly to a wood planing machine with coupling units that can prevent loosening of a cutter carriage during a planing operation.

2. Description of the Related Art

U.S. Pat. No. 6,427,734 discloses a conventional wood planing machine that includes a cutter carriage that is mounted movably on a plurality of screw rods through a plurality of threaded members which engage threadedly and respectively the screw rods. The conventional wood planing machine requires the use of eccentric members to adjust positions of the threaded members relative to the cutter carriage so as to permit abutment of the threaded members against the screw rods and so as to firmly secure the threaded members to the screw rods when the cutter carriage is moved to a desired height on the screw rods, thereby preventing loosening of the cutter carriage on the screw rods and undesired clashing between the threaded members and the screw rods during a planing operation.

The entire disclosure of U.S. Pat. No. 6,427,734 is incorporated herein by reference.

SUMMARY OF THE INVENTION

Therefore, it is an object of the present invention to provide a wood planing machine having coupling units that are capable of dispensing with the use of eccentric members as required in the aforesaid conventional wood planing machine.

Accordingly, a wood planing machine of this invention comprises: a base; a plurality of screw rods mounted rotatably on and standing upright from the base, each of the screw rods having a helical thread that defines upper and lower helical surfaces; a cutter carriage formed with a plurality of coupler-engaging parts, each of which is formed with opposite upper and lower coupler-receiving holes for extension of a respective one of the screw rods therethrough, upper and lower fastener-receiving holes that are respectively in spatial communication with and that are transverse to the upper and lower coupler-receiving holes, and upper and lower inner threads that respectively define the upper and lower fastener-receiving holes; a plurality of coupling units, each of which includes upper and lower couplers that extend respectively into the upper and lower coupler-receiving holes of a respective one of the coupler-engaging parts, each of the upper and lower couplers having a head portion and a shank portion that is reduced in diameter and that extends from the head portion into the respective one of the upper and lower coupler-receiving holes, and being formed with an inner hole extending through the head and shank portions for extension of a respective one of the screw rods therethrough, and an inner thread defining the inner hole and engaging threadedly the respective one of the screw rods so as to permit movement of the cutter carriage along the screw rods upon rotation of the screw rods relative to the cutter carriage, the inner thread defining upper and lower helical surfaces; and a plurality of fastening units, each of which includes upper and lower screws that are engageable threadedly and respectively with the upper and lower inner threads of a respective one of the coupler-engaging parts and that are extendable respectively into the upper and lower coupler-receiving holes to engage releasably and respectively the shank portions of the upper and lower couplers for securing the upper and lower couplers to the cutter carriage. The upper and lower screws are operable to permit position adjustment of the upper and lower couplers relative to the cutter carriage to a tightening position, in which the upper helical surface of the inner thread of the upper coupler abuts against the lower helical surface of the helical thread of a respective one of the screw rods and in which the lower helical surface of the inner thread of the lower coupler abuts against the upper helical surface of the helical thread of the respective one of the screw rods.

BRIEF DESCRIPTION OF THE DRAWINGS

In drawings which illustrate an embodiment of the invention.

DETAILED DESCRIPTION OF THE PREFERRED EMBODIMENT

Figure 1:
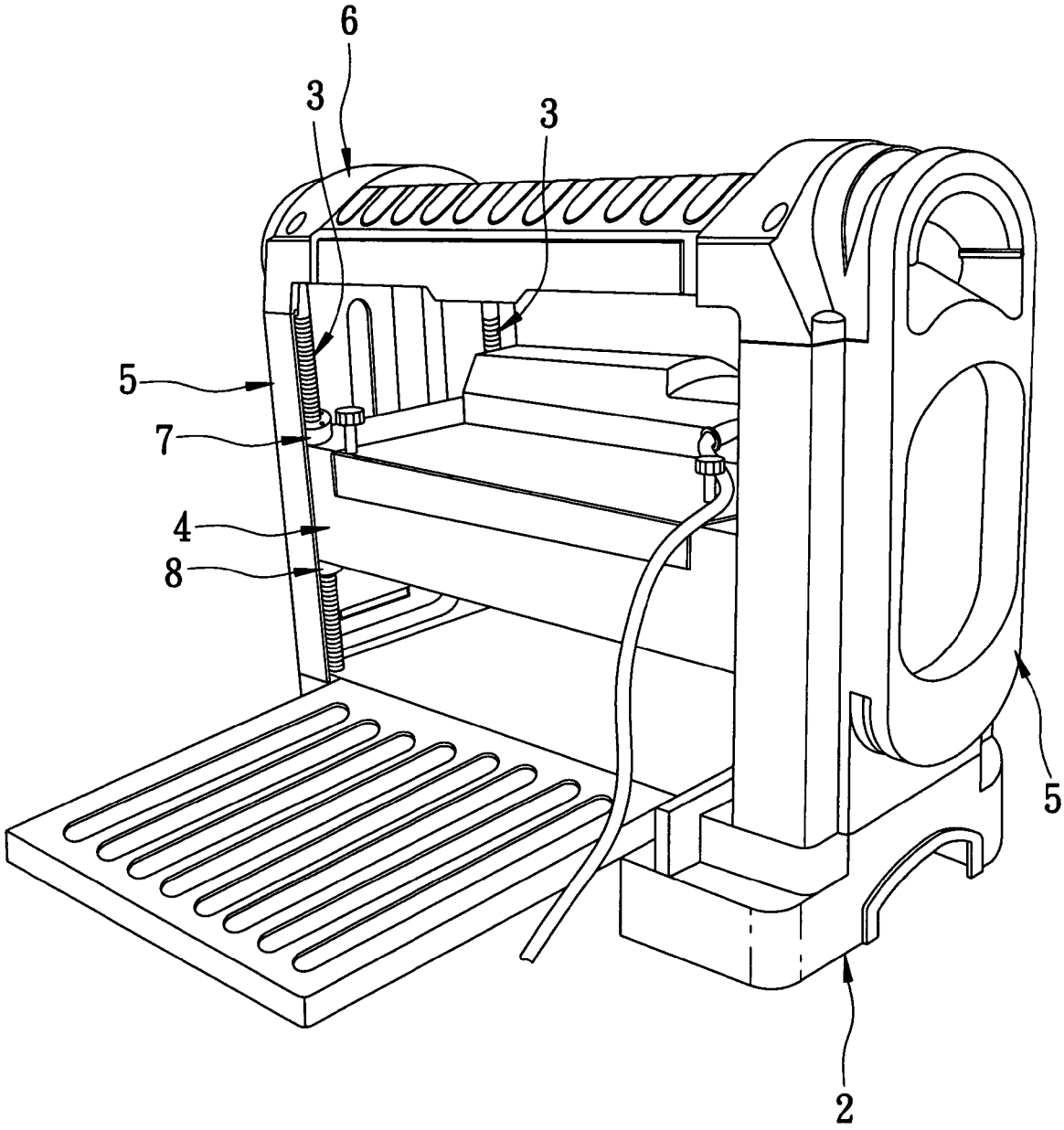
FIG. 1 is a perspective view of the preferred embodiment of a wood planing machine according to this invention.
Figure 2:
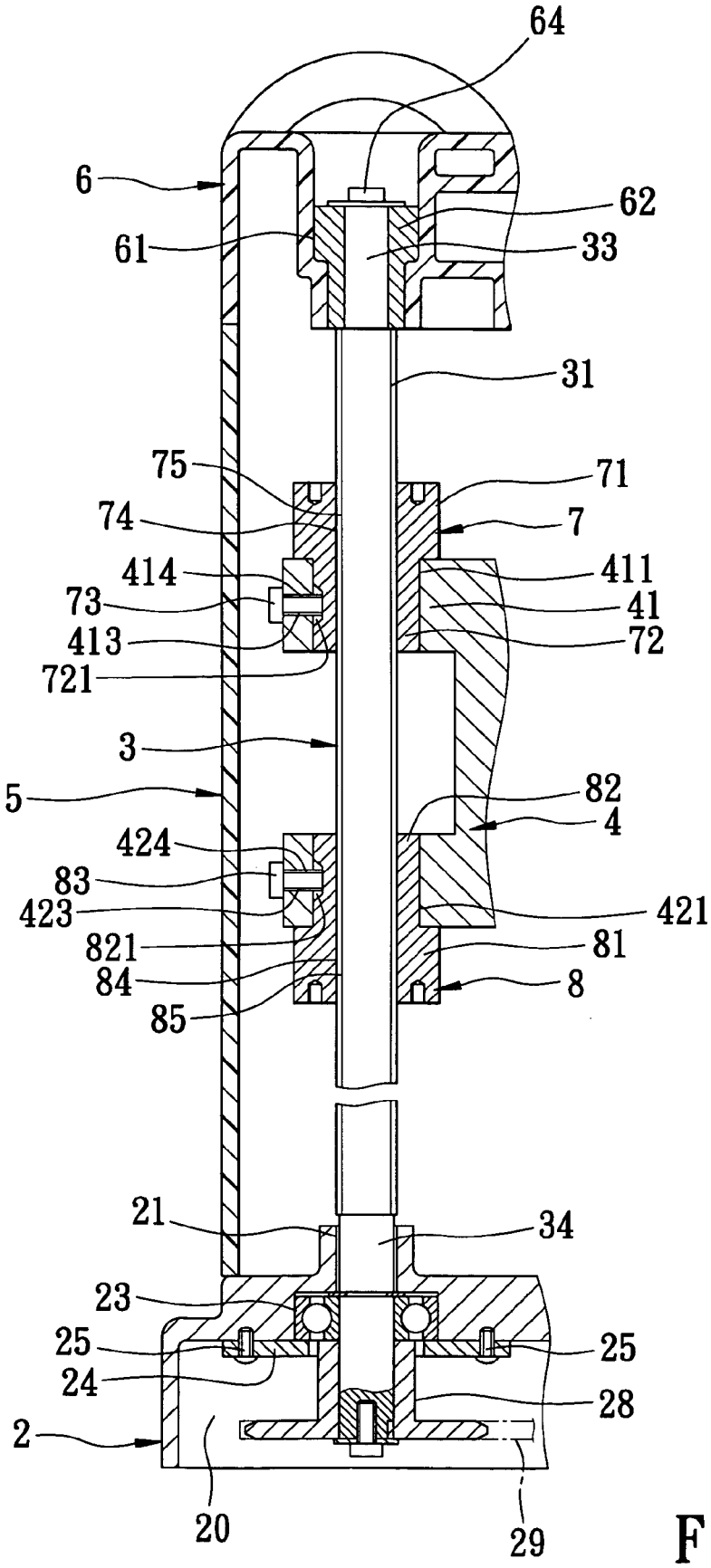
FIG. 2 is a fragmentary sectional view to illustrate how upper and lower couplers are secured to a cutter carriage and engage a screw rod of the wood planing machine of the preferred embodiment.
Figure 4:
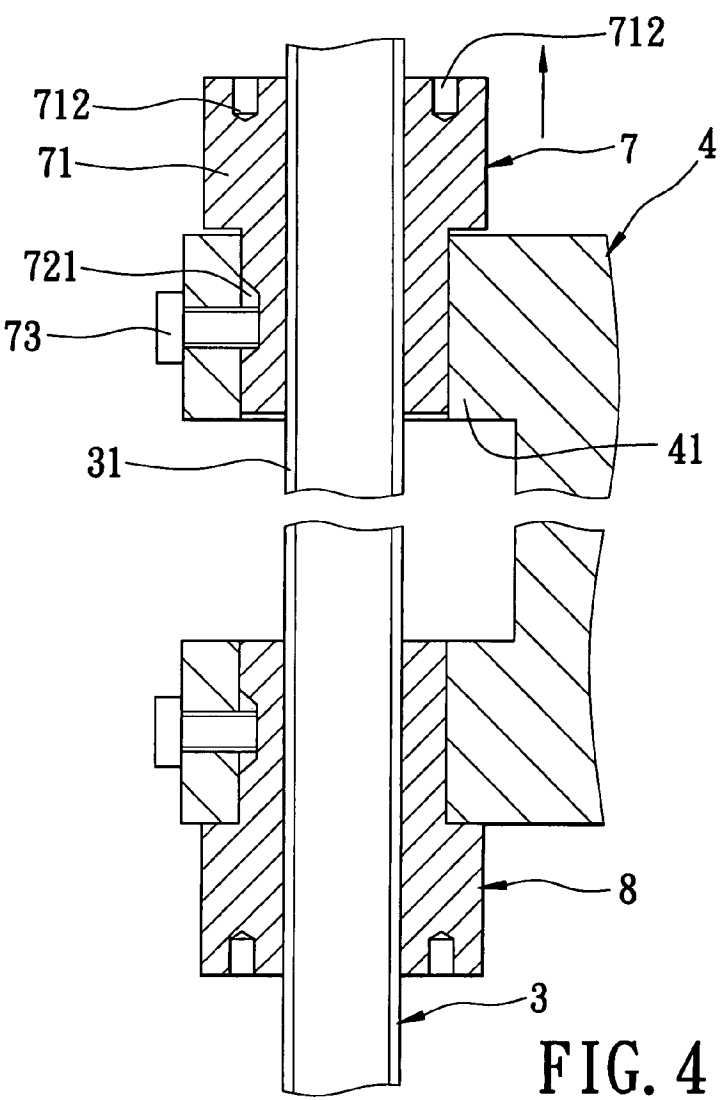
FIGS. 3 and 4 are fragmentary sectional views to illustrate how the upper coupler is adjusted from a non-tightening position to a tightening position according to this invention.

FIGS. 1 to 5 illustrate the preferred embodiment of a wood planing machine according to this invention.

Figure 6:
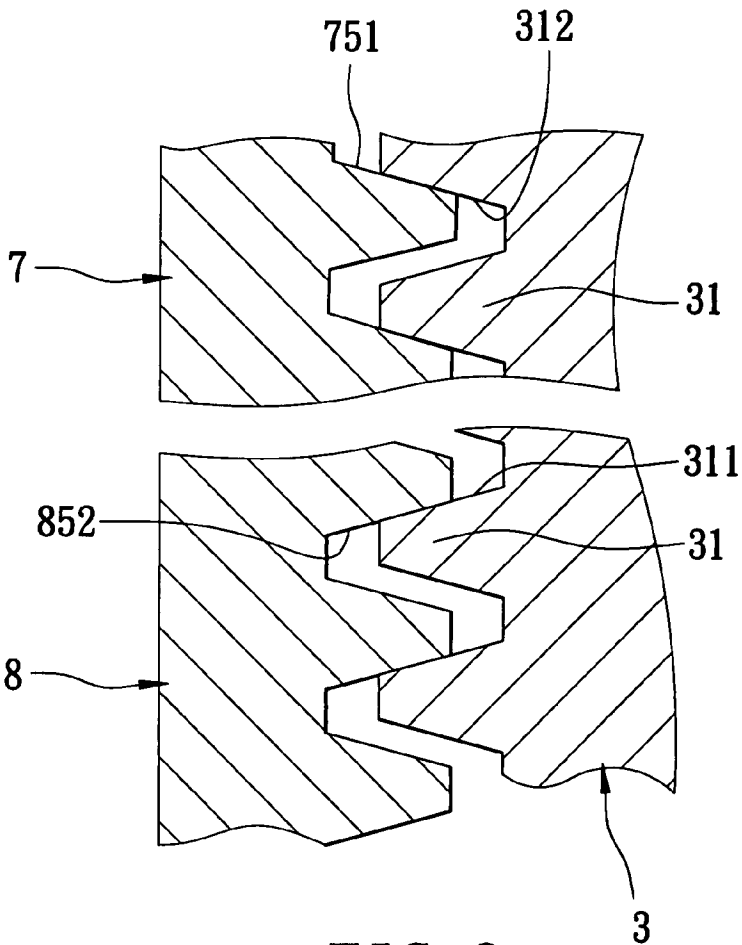
FIG. 6 is a fragmentary sectional view to illustrate threaded engagement between the upper coupler and the screw rod when the upper coupler is disposed at the tightening position according to this invention.
Figure 5:
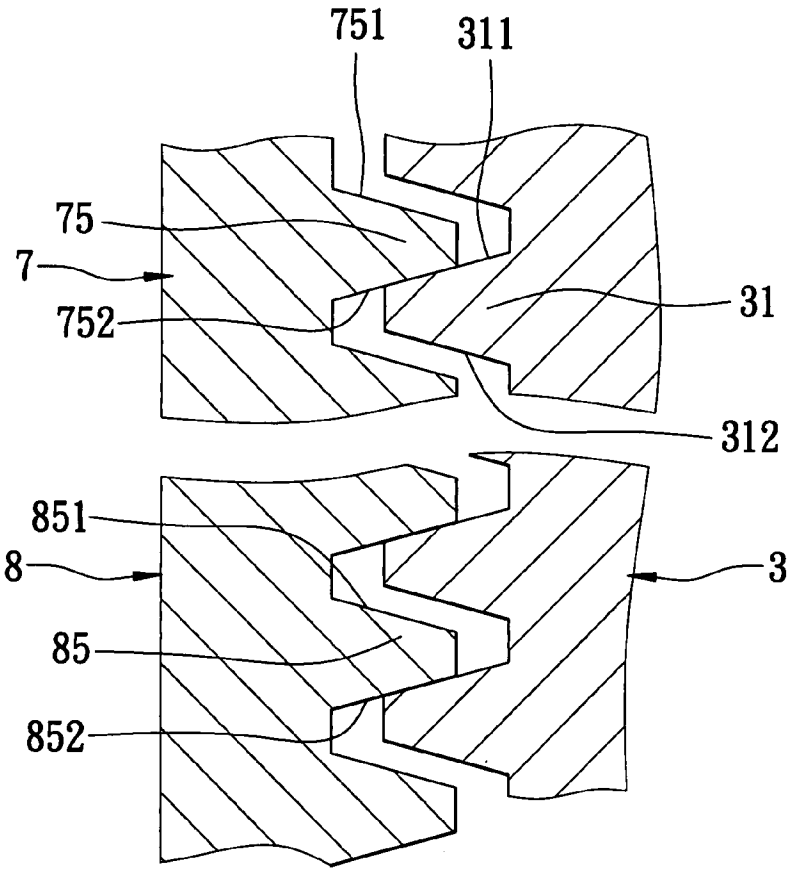
FIG. 5 is a fragmentary sectional view to illustrate threaded engagement between the upper coupler and the screw rod when the upper coupler is disposed at the non-tightening position according to this invention.

The wood planing machine includes: a housing with a base 2; a plurality of screw rods 3 mounted rotatably on and standing upright from the base 2, each of the screw rods 3 having a helical thread 31 (see FIG. 5) that defines upper and lower helical surfaces 311, 312; a cutter carriage 4 formed with a plurality of coupler-engaging parts 41, each of which is formed with opposite upper and lower coupler-receiving holes 411, 421 for extension of a respective one of the screw rods 3 therethrough, upper and lower fastener-receiving holes 413, 423 that are respectively in spatial communication with and that are transverse to the upper and lower coupler-receiving holes 411, 421, and upper and lower inner threads 414, 424 that respectively define the upper and lower fastener-receiving holes 413, 423; a plurality of coupling units, each of which includes upper and lower couplers 7, 8 that extend respectively into the upper and lower coupler-receiving holes 411, 421 of a respective one of the coupler-engaging parts 41, each of the upper and lower couplers 7, 8 having a head portion 71 (81) and a shank portion 72 (82)

that is reduced in diameter and that extends from the head portion 71 (81) into the respective one of the upper and lower coupler-receiving holes 411, 421, and being formed with an inner hole 74 (84) extending through the head and shank portions 71, 72 (81, 82) for extension of a respective one of the screw rods 3 therethrough, and an inner thread 75 (85) defining the inner hole 74 (84) and engaging threadedly the respective one of the screw rods 3 so as to permit movement of the cutter carriage 4 along the screw rods 3 upon rotation of the screw rods 3 relative to the cutter carriage 4, the inner thread 75 (85) defining upper and lower helical surfaces 751, 752 (851, 852); and a plurality of fastening units, each of which includes upper and lower screws 73, 83 that are engageable threadedly and respectively with the upper and lower inner threads 414, 424 of a respective one of the coupler-engaging parts 41 and that are extendable respectively into the upper and lower coupler-receiving holes 411, 421 to engage releasably and respectively the shank portions 72, 82 of the upper and lower couplers 7, 8 for securing the upper and lower couplers 7, 8 to the cutter carriage 4. The upper and lower screws 73, 83 are operable to permit position adjustment of the upper and lower couplers 7, 8 relative to the cutter carriage 4 between a non-tightening position (see FIG. 5) and a tightening position (see FIG. 6), in which the upper helical surface 751 of the inner thread 75 of the upper coupler 7 abuts against the lower helical surface 312 of the helical thread 31 of a respective one of the screw rods 3 and in which the lower helical surface 852 of the inner thread 85 of the lower coupler 8 abuts against the upper helical surface 311 of the helical thread 31 of the respective one of the screw rods 3.

Figure 3:
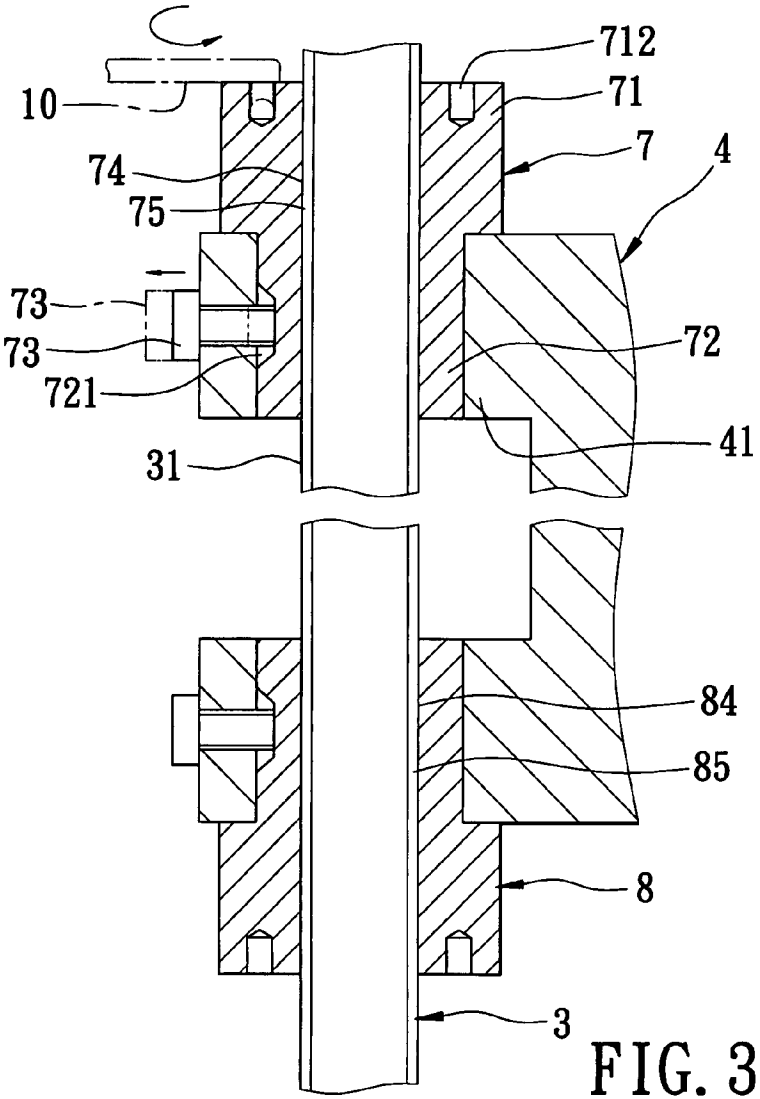
Figure 7:
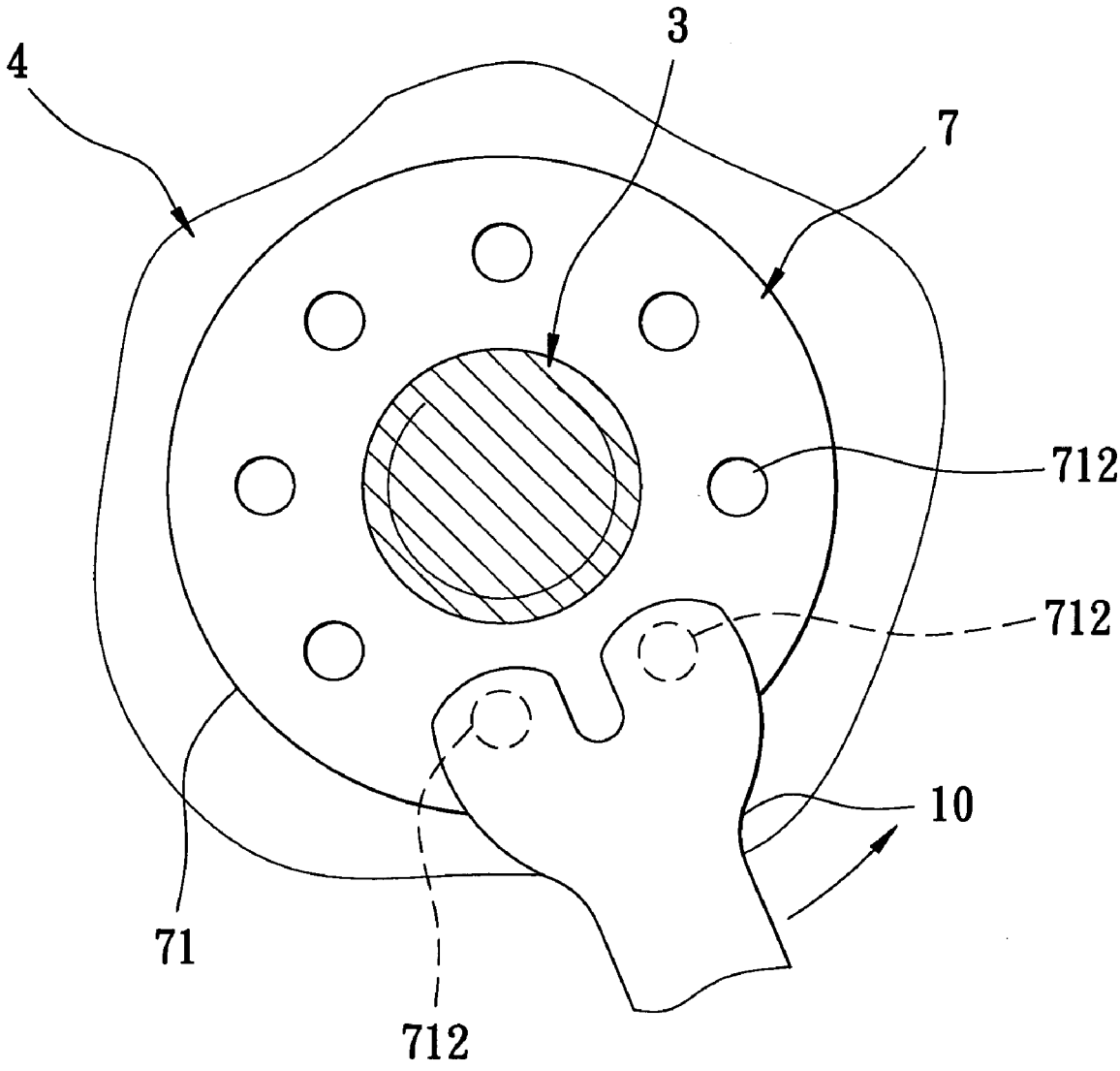
FIG. 7 is a fragmentary top view to illustrate how the upper coupler is adjusted using a tool.

Referring to FIG. 7, in combination with FIG. 3, adjustment of the upper coupler 7 from the non-tightening position to the tightening position is carried out using a tool 10 with protrusions that extend respectively into angularly displaced tool-engaging holes 712 in the head portion 71 of the upper coupler 7. The tool 10 is rotated in a direction indicated by the arrows shown in FIGS. 3 and 7 so as to move the upper coupler 7 from the non-tightening position to the tightening position. In a similar manner, the head portion 81 of the lower coupler 8 is also formed with a plurality of angularly displaced tool-engaging holes such that rotation of the lower coupler 8 is possible through the tool 10.

In this embodiment, the shank portion 72 (82) of each of the upper and lower couplers 7, 8 is formed with a recess 721 (821). Each of the upper and lower screws 73, 83 is extendable into the recess 721 (821) in the shank portion 72 (82) of the respective one of the upper and lower couplers 7, 8 to engage releasably the respective one of the upper and lower couplers 7, 8 so as to ensure fastening of the upper and lower couplers 7, 8 to the cutter carriage 4.

Referring back to FIGS. 1 and 2, the housing further includes two opposite side covers 5 confining two opposite sides of the cutter carriage 4, and a top cover 6 interconnecting the side covers 5 and confining a top side of the cutter carriage 4. The top cover 6 is formed with a plurality of positioning holes 61, each of which receives a sleeve 62 therein. Each of the screw rods 3 has an upper end portion 33 that is sleeved by the sleeve 62, and that is retained in a respective one of the positioning holes 61 by fastening means 64. The base 2 defines a bottom mounting space 20, and is formed with a plurality of retaining holes 21, each of which is in spatial communication with the bottom mounting space 20 and each of which receives a bearing 23 therein. The bearing 23 is retained in the respective retaining hole 21 by a retaining plate 24 and fastening means 25. Each of the screw rods 3 further has a lower end portion 34 that extends through the bearing 23 in a respective one of the retaining holes 21, and is connected to a sprocket 28 that is disposed in the bottom mounting space 20. A chain 29 is connected to the sprockets 28 on the screw rods 3 so as to permit synchronous rotation of the screw rods 3.

By virtue of the upper and lower couplers 7, 8, the wood planing machine of this invention can be dispensed with the use of the eccentric members that are required in the aforesaid conventional wood planing machine.

With the invention thus explained, it is apparent that various modifications and variations can be made without departing from the spirit of the present invention. It is therefore intended that the invention be limited only as recited in the appended claims.

I claim:

1. A wood planing machine comprising:

a base;

a plurality of screw rods mounted rotatably on and standing upright from said base, each of said screw rods having a helical thread that defines upper and lower helical surfaces;

a cutter carriage formed with a plurality of coupler-engaging parts, each of which is formed with opposite upper and lower coupler-receiving holes for extension of a respective one of said screw rods therethrough, upper and lower fastener-receiving holes that are respectively in spatial communication with and that are transverse to said upper and lower coupler-receiving holes, and upper and lower inner threads that respectively define said upper and lower fastener-receiving holes;

a plurality of coupling units, each of which includes upper and lower couplers that extend respectively into said upper and lower coupler-receiving holes of a respective one of said coupler-engaging parts, each of said upper and lower couplers having a head portion and a shank portion that is reduced in diameter and that extends from said head portion into the respective one of said upper and lower coupler-receiving holes, and being formed with an inner hole extending through said head and shank portions for extension of a respective one of said screw rods therethrough, and an inner thread defining said inner hole and engaging threadedly the respective one of said screw rods so as to permit movement of said cutter carriage along said screw rods upon rotation of said screw rods relative to said cutter carriage, said inner thread defining upper and lower helical surfaces; and a plurality of fastening units, each of which includes upper and lower screws that are engageable threadedly and respectively with said upper and lower inner threads of a respective one of said coupler-engaging parts and that are extendable respectively into said upper and lower coupler-receiving holes to engage releasably and respectively said shank portions of said upper and lower couplers for securing said upper and lower couplers to said cutter carriage, said upper and lower screws being operable to permit position adjustment of said upper and lower couplers relative to said cutter carriage to a tightening position, in which said upper helical surface of said inner thread of said upper coupler abuts against said lower helical surface of said helical thread of a respective one of said screw rods and in which said lower helical surface of said inner thread of said lower coupler abuts against said upper helical surface of said helical thread of the respective one of said screw rods.

2. The wood planing machine of claim 1, wherein said shank portion of each of said upper and lower couplers is formed with a recess, each of said upper and lower screws being extendable into said recess in said shank portion of the respective one of said upper and lower couplers to engage releasably the respective one of said upper and lower couplers.

3. The wood planing machine of claim 1, wherein said head portion of each of said upper and lower couplers is formed with a plurality of angularly displaced tool-engaging holes.

* * * * *